United States Patent [19]

Henning

[11] Patent Number: 4,595,863

[45] Date of Patent: Jun. 17, 1986

[54] D.C. LUMINOUS TUBE SYSTEM

[75] Inventor: Haden V. Henning, Arlington, Tex.

[73] Assignee: Lightmasters, Ltd., Dallas, Tex.

[21] Appl. No.: 545,639

[22] Filed: Oct. 26, 1983

[51] Int. Cl.[4] ..... H05B 37/00; H05B 39/00; H05B 41/14

[52] U.S. Cl. ..... 315/208; 315/DIG. 4; 315/DIG. 5; 315/240; 315/156; 315/158; 315/223; 315/241 R

[58] Field of Search ..... 315/DIG. 4, DIG. 5, 315/DIG. 7, 156, 158, 219, 223, 240, 241, 208

[56] References Cited

U.S. PATENT DOCUMENTS

| | | | |
|---|---|---|---|
| 4,051,411 | 9/1977 | Knoble et al. | 315/219 |
| 4,051,412 | 9/1977 | Knoble et al. | 315/219 |
| 4,189,663 | 2/1980 | Schmutzer et al. | 315/DIG. 5 |
| 4,194,143 | 3/1980 | Farkas et al. | 315/241 R |
| 4,197,485 | 4/1980 | Nuver | 315/158 |
| 4,275,335 | 6/1981 | Ishida | 315/158 |
| 4,358,717 | 11/1982 | Elliott | 315/DIG. 7 |
| 4,385,262 | 5/1983 | Cambier | 315/DIG. 4 |
| 4,469,981 | 9/1984 | Ruff et al. | 315/DIG. 7 |

*Primary Examiner*—Saxfield Chatmon

*Attorney, Agent, or Firm*—Richards, Harris, Medlock & Andrews

[57] ABSTRACT

A luminous gas filled tube system has a direct current source, a pulse transformer secondary winding, the emitter-collector path of a transistor, and the gas filled tube connected in series. The voltage of the source is below the ionization potential of the gas in the tube but adequate to supply current when the gas is ionized. A pulse source is connected for selectively generating a high voltage pulse in the winding of magnitude such that, when added to the voltage from the source, the ionization potential of the gas is exceeded. A starter circuit is provided for selectively actuating the pulse source to initiate ionization of the gas in the tube. A variable resistor is provided for selecting the amount of current flowing in the series circuit at any level below a maximum rating of the transistor.

6 Claims, 2 Drawing Figures

D.C. LUMINOUS TUBE SYSTEM

TECHNICAL FIELD

This invention relates to initiating and controlling operation of luminous gas filled tubes utilizing direct current.

BACKGROUND OF THE INVENTION

Neon tubes and similar gas filled tubes are widely used in advertising and information display systems. In those systems, alternating current voltages are applied to electrodes located at opposite ends of a tube. If the voltage is high enough, the gas becomes ionized as electrons are attracted toward the positive electrode. In the course of such travel, they collide with neutral gas molecules in their paths causing the body of the gas to become ionized. The free electrons combine with positive ions and give off light as they do so.

Incandescent indicators, also widely used, are relatively expensive and contain large numbers of components. They are inefficient and require relatively large primary power sources. Furthermore, they are more costly to operate and maintain than gas filled tubes primarily due to bulb and control system failures.

Thus, luminous tubes are used primarily for both non-changing informational and on/off (flashing) applications. This limited application is principally due to the fact that a high leakage/reactance luminous tube transformer is required for each individual section of luminous tubing. Informational luminous tube indicators which change with time could be fabricated using large numbers of such transformers or using a mechanical switching network capable of dealing with the high voltage environment inherent in such transformers. Both of these approaches, however are economically impractical.

The problem involved in luminous tube systems using alternating current is to provide a high voltage in order to start the unit, and then abruptly to effect a lower voltage during the run interval in each half cycle. The transformers used in these systems operate in such a way that an initial high secondary voltage is reduced abruptly as high current flow is initiated. If too great a current is drawn, the voltage goes down almost to zero and high current can no longer flow. These transformers are generally described as having poor regulation.

It is advantageous to be able to provide luminous multi-tube indicators capable of changing informational content and operated from a direct current power supply by providing separately the ionization and sustaining voltages, thereby eliminating large luminous tube transformers and most of the associated high voltage wiring.

It is advantageous to be able to control individual luminous tube elements with a low voltage control signal and a mechanical switch or a solid-state (semiconductor) control device. This invention utilizes a luminous tube switch with integral low voltage control.

Accordingly, it is an object of this invention to provide a luminous multi-tube system having improved low voltage on-off switching.

Another object of this invention is to provide operation from a direct current power supply and provide static or multiplex element control.

It is yet another object of this invention to provide selectable on-off and brightness control in displays of various formats such as seven segment, dot matrix and other displays.

SUMMARY OF THE INVENTION

This invention relates to D.C. operation of luminous gas filled tube systems and, more particularly, to a circuit for initiating and operating a luminous gas filled tube.

To actuate the luminous tube, a starter circuit is connected to D.C. power supply which is sufficient to maintain current flow through the tube following ionization of the gas.

Means are provided in the starter circuit to add a high voltage pulse to the voltage from the power supply such that the combined voltage is adequate to ionize the gas in the tube. One embodiment of the invention includes a pulse transformer whose secondary winding is in series circuit with the tube, the D.C. power supply and the starter. The primary winding of the pulse transformer is connected to a low level pulse circuit which generates a high voltage pulse in the secondary winding to ionize the gas.

A constant current driver for controlling the current in the tube may comprise a transistor connected by way of the emitter-collector path in series circuit with the tube, the starter and the power supply.

A reference voltage source is connected to the base of the series transistor to control the current flow through the series transistor to the tube. Means in the base-emitter circuit of the series transistor provides for terminating the flow of current through the tube.

DETAILED DESCRIPTION

FIGURE 1

Figure 1:
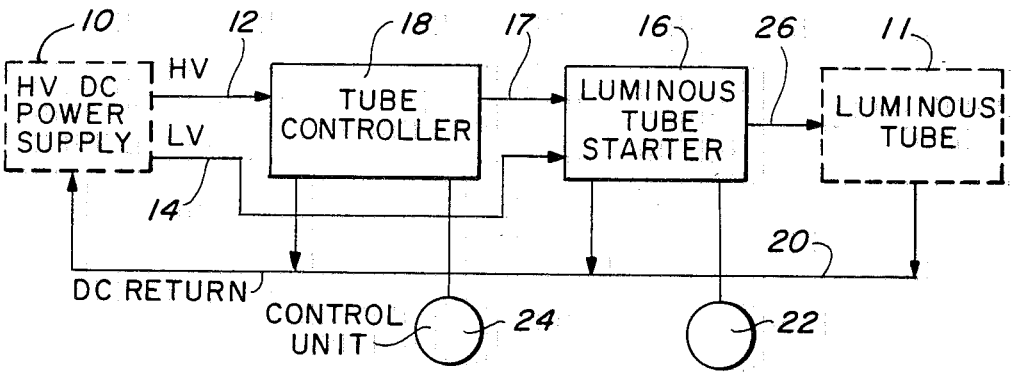
FIG. 1 is a block diagram illustrating a system involved in use of the present invention.

FIG. 1 illustrates starter and controller circuits employed with a D.C. power supply for the control of a gas filled luminous tube.

Power from a high voltage D.C. power supply 10 is to be employed for the excitation and control of tube 11.

D.C. power supply 10 has a high voltage output channel 12 and a low output voltage channel 14. The high voltage channel 12 leads to a tube controller 18 whose output appears on channel 17 and is applied to a luminous tube starter 16. The output of starter 16 is applied by way of channel 26 to a luminous tube 11. The return current from the luminous tube and from the starter 16 and controller 18 is by way of channel 20 leading back to the high voltage D.C. power supply 10.

The low voltage output channel 14 is connected to a low voltage input terminal of the starter 16. A trigger circuit 22 is provided to control starter 16. A control circuit 24 is provided for tube controller 18.

With flexibility provided by the units 16 and 18, a wide variety of end products is possible. The products may include two dimensional arrays of luminous gas tubes forming visual displays for various alpha-numeric characters. Flexibility also permits the operation of the system for multicolor, multidimensional displays of varying brightness.

A system as shown in FIG. 1 allows control of several independent luminous tubes from a common power source and it provides brightness control, permits flashing on and off, and permits luminous tube multiplexing arrangements.

FIG. 2

Luminous tube controller 18 provides capability for flashing or dimming a luminous tube by way of low voltage remote control, while also providing for constant current operation. Controller 18 is provided with short circuit protection. Controller 18 can be of small size and light weight for high reliability and maintainability.

The starter circuit, utilizing a pulse transformer, brings into the system a most significant advantage, namely small size. The pulse transformer can be very small compared with large high leakage/reactance transformers found in alternating current systems. A pulse generating circuit including the transformer employed in accordance with the present invention readily provides the capability of high frequency operation necessary in luminous tube systems having sequentially changing displays.

The starter 16 and the controller 18 cooperate in selective initiation, regulation and termination of tube operation.

Figure 2:
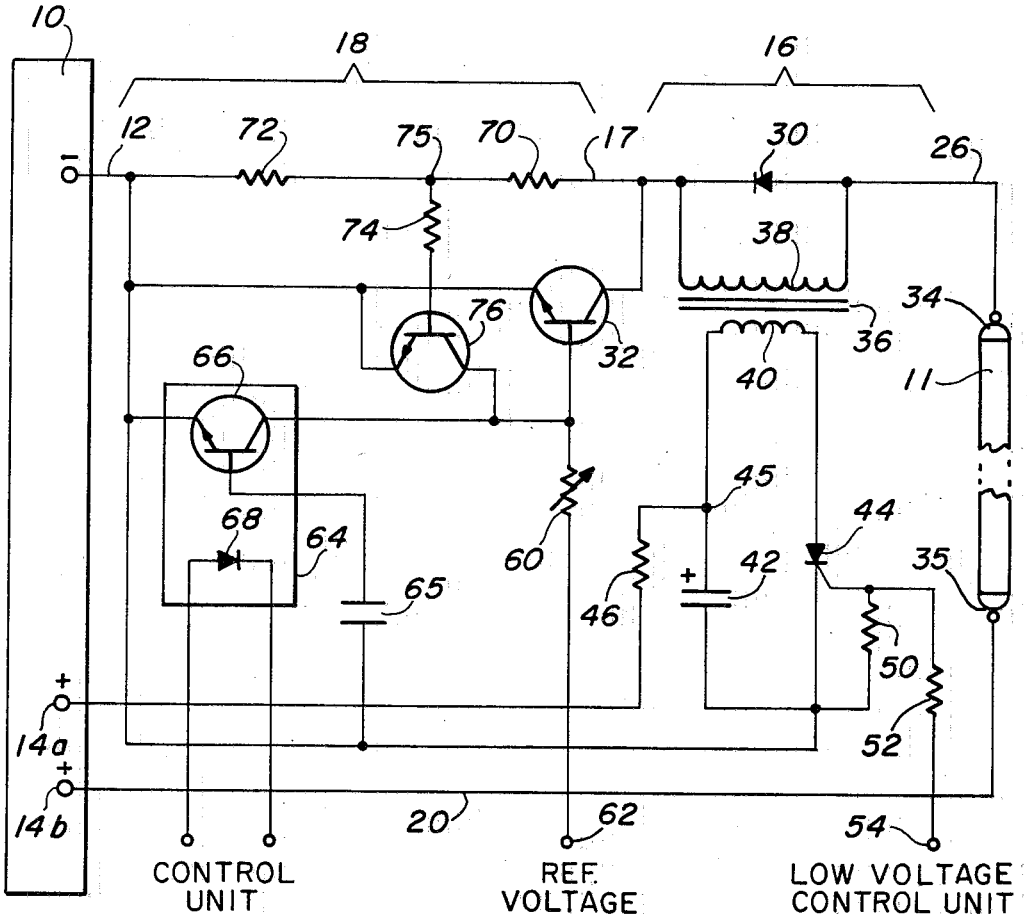
FIG. 2 is a detailed circuit diagram of a preferred embodiment of the invention.

In FIG. 2, one embodiment of starter 16 and of controller 18 are shown in detail. Conductor 12 is connected to the negative terminal of source 10. Conductor 12 is connected by way of a series transistor 32 in tube controller 18, and a series diode 30 in starter 16 to terminal 34 of luminous tube 11. Terminal 35 of tube 11 is connected by conductor 20 back to power supply 10.

A pulse transformer 36 is connected with its secondary winding 38 parallel to diode 30. The primary winding 40 of transformer 36 is connected at one terminal through a switching transistor 44 to conductor 12. The other terminal of primary winding 40 is connected to the point 45 common to a capacitor 42 and a resistor 46. Resistor 46 is connected to terminal 14*a* of power supply 10. Thus, capacitor 42 is connected to be charged via the circuit including resistor 46.

The transistor 44 is shown in the form of a silicon controlled rectifier which has a resistor 50 connecting the gate electrode of transistor 44 to conductor 12. A resistor 52 is connected to the gate electrode to apply a control voltage from low voltage control input unit to switch transistor 44.

The high D.C. voltage on line 12 typically would be of the order of 250 volts per foot of length of the tube 11, a level normally adequate to maintain conduction in tube 11 after ionization. The voltage applied to the input terminal 14 is of the order of 100 to 200 volts. Voltage applied to input terminal 54 is at one of two logic levels, such as 0 or 5 volts, for control of firing the transistor 44.

The input voltage on channel 12, effective at terminal 34, is not high enough to ionize gas in tube 11. To ionize the gas in tube 11, capacitor 42, charge via the low voltage pathh including resistor 46, is discharged when the transistor 44, operating as a switching transistor, becomes conductive. Discharge of capacitor 42 through transistor 44 by way of transformer 36 produces a high voltage pulse in the secondary winding 38, which pulse appears across the diode 30. Diode 30 in this condition is back biased so that the full secondary voltage of transformer 36 will appear across diode 30 and will thus be added to the voltage from source 10 to ionize the gas and initiate operation of the tube. Thus, the high voltage on line 12 leading from the supply 10 is effectively added to the momentary high voltage pulse produced in the secondary winding 38 so that the sum of the voltages is of magnitude adequate to ionize the gas in tube 11. Normally this is on the order of five to ten times the voltage from supply 10.

With the flow of current from source 10 established through tube 11, the series transistor 32 operates to maintain a desired level of current flow. The level of current flow will depend upon the magnitude of the voltage applid to the base of transistor 32 by way of an adjustable control. In the embodiment shown, control is represented by the variable resistor 60 connected between the base of transistor 32 and a suitable reference voltage source 62. Transistor 32 is connected at the emitter thereof to high voltage conductor 12 and to conductor 17 by way of the collector of transistor 32.

Means are provided in the circuits connected to transistor 32 for extinguishing tube 11. This is done in one mode by use of an opto-coupler 64 which includes a phototransistor 66, the emitter of which is connected to the high voltage conductor 12. The collector of phototransistor 66 is connected directly to the base of transistor 32. Opto-coupler unit 64 also includes a light emitting diode 68 which provides for low voltage control of phototransistor 66. Phototransistor 66 is connected by way of capacitor 65 to conductor 12.

When tube 11 is to be extinguished, a pulse of light is generated bhy light emitting diode 68. This actuates the phototransistor 66 to apply a short voltage pulse to the base of transistor 32, thereby terminating conduction through transistor 32 for a period of time that will permit the gas to be deionized.

A circuit including a transistor 76, provides short circuit protection for transistor 32. Transistor 76 is connected in parallel to phototransistor 66 but is base biased by a fraction of the voltage drop across transistor 32. This is provided by the series resistors 70 and 72 connected across the emitter-collector path of transistor 32. A resistor 74 is connected to the base of transistor 76 and to the common junction 75 between resistors 70 and 72.

If conductor 26 and the return path 20 become short circuited, transistor 32, if not protected, would be damaged. To avoid such damage the voltage applied to the base of transistor 76 by way of resistor 74 responds to high current flow to effectively turn off transistor 32 and prevent damage. Thus, when a short circuit occurs, the current flow through resistors 70 and 72 develops a voltage at point 75 common to resistors 70 and 72 to cause transistor 76 to turn off the transistor 32. The control action in this circuit is sufficiently rapid that the high voltage exists across the emitter-collector electrodes of transistor 32 for only a period of time so short as to prevent damage to transistor 32.

From the foregoing, it will be seen that the starter circuit 16 operates in series with the main luminous tube current path and adds a necessary "boost" or starting voltage to the high voltage D.C. supply. The D.C. supply voltage needs to be only high enough to supply the required sustaining voltage of the luminous tube. The starter circuit 16 provides high impulse energy of short duration, thereby allowing the high voltage source to supply only the continous power at a significantly reduced voltage. Such a starter circuit may be employed to start more than one luminous tube operating from a single high voltage power supply, in static and multiplex modes.

Diode 30 provides a conduction path for the main tube current after ionization and provides reverse blocking during starting. The reverse blocking characteristic provides the means for adding the high impulse voltage to the high voltage sustaining supply, thereby together providing the starting potential requirement of the luminous tube.

The secondary winding 38 of transformer 36 applies the necessary voltage impulse, the level of which is based on the turns ratio of the transformer 36.

Resistor 46 limits the charge rate of capacitor 42 and ensures that the minimum hold current of transistor 44 is not met at the end of firing duration. The voltage on and the capacitance of capacitor 42 are determined by the energy required of the luminous tube. The discharge rate of capacitor 42 is determined primarily by winding 40 and switch transistor 44.

Resistors 50 and 52 provide transistor 44 biasing gate protection and form the input for the low voltage firing signal.

From the foregoing it will be seen that there are provided suitable excitation and control systems for luminous gas filled tubes. A direct current source, a transformer secondary winding, the emitter-collector path of the transistor, and the luminous tube are connected in a series circuit relationship. The voltage from the direct current source is below the ionization potential of the gas in the tube, and preferably is of a level just adequate to supply current at the level necessary to run the tube once the gas is ionized.

A pulse source is connected for selectively generating a high voltage pulse in the transformer winding of magnitude such that, when added to the voltage from the direct current source, the total voltage exceeds the ionization potential of the gas. Means are provided for selectively actuating the pulse source to initiate ionization of the gas in the tube. A control circuit means is provided for the series transistor to determine the amount of current flowing in the series circuit at any level below a maximum rating of the transistor. On/off control renders the system capable of a wide variety of modes of operation and permits this to be accomplished by utilization of components that permit small, compact packaging and eliminate the drawbacks attendant the prior art uses of large bulky transformers heretofore required for each luminous tube. The significant reduction of transformer size is made possible by the use of a D.C. source in a circuit such as illustrated herein. Dimming operations are accommodated by controlling the current level through variation in the bias of transistor 32.

The circuit shown in FIG. 2 is in the negative mode in that transistor 32 is an NPN transistor. The circuit may be altered, in a manner known to those skilled in the art, to provide for PNP modes of operation.

Having described the invention in connection with certain specific embodiments thereof, it is to be understood that further modifications may now suggest themselves to those skilled in the art and it is intended that this disclosure cover such modifications as fall within the scope of the appended claims.

We claim:

1. A luminous gas filled tube system, comprising:

(a) a direct current power source connected in series with the luminous tube, said power source having a voltage less than the ionization potential of the gas but providing current through the tube when the gas is ionized;

(b) a tube starter circuit, including:

(1) a transformer having its secondary winding connected in series with the tube and said power source;

(2) a storage capacitor connected to said power source and the primary winding of said transformer;

(3) pulse means for selectively discharging said capacitor through said primary winding to produce a high voltage pulse in said secondary winding, said high voltage pulse combining with the voltage provided by said power source to thereby ionize the gas in the tube;

(c) a tube controller circuit, including:

(1) a series transistor having its emitter-collector path connected in series with said tube, said power source, and said secondary winding of said transformer;

(2) control means connected to the base of said series transistor for adjusting the flow of current through the emitter-collector of said series transistor; and (3) optocoupler means connected to said power source and the base of said series transistor for selectively interrupting current flow through the emitter-collector of said series transistor, thereby permitting the gas in the tube to deionize and extinguish the luminous tube.

2. The luminous tube system of claim 1, wherein said pulse means includes:

(a) a semiconductor switch connected in the circuit containing said storage capacitor and said primary winding of said transformer; and (b) a low voltage control unit connected to the gate of said switch for selectively causing said switch to become conductive, thereby allowing said storage capacitor to discharge through said primary winding.

3. The luminous tube system of claim 2, wherein said switch is a silicon controlled rectifier.

4. The luminous tube system of claim 1, wherein said control means includes:

(a) a reference voltage source connected to the base of said series transistor; and (b) a variable resistor connected between said reference voltage source and said series transistor.

5. The luminous tube system of claim 1, wherein said optocoupler means includes:

(a) a phototransistor having its collector connected to the base of said series transistor and its emitter connected to said power source; and (b) a light emitting diode for selectively generating a light pulse, said light pulse actuating said phototransistor to apply a short voltage pulse to the base of said series transistor, thereby interrupting current flow through the emitter-collector of said series transistor to extinguish the luminous tube.

6. A system for initiating and controlling the operation of a luminous gas filled tube, comprising:

a direct current power source connected in series with the luminous tube, said power source having a voltage less than the ionization potential of the gas but providing current through the tube when the gas is ionized;

a transformer having its secondary winding connected in series with the tube and said power source;

a storage capacitor connected to said power source and the primary winding of said transformer;

a silicon controlled rectifier connected in the circuit containing said storage capacitor and said primary winding;

a low voltage control unit connected to said silicon controlled rectifier for selectively causing said silicon controlled rectifier to become conductive, thereby allowing said storage capacitor to discharge through said primary winding to produce a high voltage pulse in said secondary winding;

a diode connected in parallel with said secondary winding and biased so that said high voltage pulse is added to the voltage of said power source to cause the gas in the tube to ionize;

a series transistor having its emitter-collector path connected in series with said tube, said power source, and said secondary winding;

a reference voltage source connected to the base of said series transistor;

a variable resistor connected between said reference voltage source and said series transistor for adjusting the flow of current through the emitter-collector of said series transistor;

a phototransistor having its collector connected to the base of said series transistor and its emitter connected to said power source;

a light emitting diode having means for selectively generating a light pulse, said light pulse illuminating and actuating said phototransistor to apply a short voltage pulse to the base of said series transistor, thereby interrupting current flow through the emitter-collector of said series transistor to extinguish the luminous tube; and a short circuit protection transistor connected in parallel with said phototransistor and having its base biased so as to respond to high current flow through the circuit containing said series transistor by turning of said series transistor.

* * * * *